US006273184B1

(12) United States Patent
Nishishita

(10) Patent No.: US 6,273,184 B1
(45) Date of Patent: Aug. 14, 2001

(54) PARALLEL-DISPOSED INTEGRAL HEAT EXCHANGER

(75) Inventor: Kunihiko Nishishita, Konan (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 09/647,779

(22) PCT Filed: Apr. 2, 1999

(86) PCT No.: PCT/JP99/01747

§ 371 Date: Oct. 5, 2000

§ 102(e) Date: Oct. 5, 2000

(87) PCT Pub. No.: WO99/53253

PCT Pub. Date: Oct. 21, 1999

(30) Foreign Application Priority Data

Apr. 9, 1998 (JP) ..... 10-114254

(51) Int. Cl.[7] ..... F28D 7/10

(52) U.S. Cl. ..... 165/140; 165/153; 165/175

(58) Field of Search ..... 165/148, 140, 165/151, 152, 153, 173, 175, 176, 181, 182, 135

(56) References Cited

U.S. PATENT DOCUMENTS

| | | | | |
|---|---|---|---|---|
| 3,298,432 | * | 1/1967 | Przyborowski | 165/140 |
| 3,993,125 | * | 11/1976 | Rhodes | 165/152 |
| 4,311,193 | * | 1/1982 | Verhaeghe et al. | 165/153 |
| 4,328,861 | * | 5/1982 | Cheong et al. | 165/151 |
| 4,693,307 | * | 9/1987 | Scarselletta | 165/152 |
| 5,033,540 | * | 7/1991 | Tategami et al. | 165/140 |
| 5,289,874 | * | 3/1994 | Kadle et al. | 165/152 |
| 5,350,012 | * | 9/1994 | Sadowski et al. | 165/153 |
| 5,992,514 | * | 11/1999 | Sugimoto et al. | 165/140 |
| 6,095,239 | * | 8/2000 | Makino et al. | 165/140 |

FOREIGN PATENT DOCUMENTS

| | | |
|---|---|---|
| 2-14582 | 1/1990 | (JP) . |
| 3-96581 | 10/1991 | (JP) . |

* cited by examiner

*Primary Examiner*—Ira S. Lazarus
*Assistant Examiner*—Terrell McKinnon
(74) *Attorney, Agent, or Firm*—Wenderoth, Lind & Ponack, L.L.P.

(57) ABSTRACT

In a parallel integrated heat exchanger achieved by joining a plurality of heat exchangers with their heat exchanging units facing opposite each other and integrated fins formed to be shared by adjacent heat exchangers, performance-improving louvers 31*a* and 32*a* are formed between the tubes of the individual heat exchangers and heat transfer prevention louvers 32*b* are formed over the entire area between the tubes 3 of a condenser 5 and the tubes 7 of a radiator 9. The heat transfer prevention louvers 32*b* are formed continuous to, at least, the performance-improving louvers 32*a* formed at one of the heat exchangers. The heat transfer prevention louvers 32*b* and the performance-improving louvers 32*a* formed continuously are made to incline along the same direction. By forming the heat transfer prevention louvers over the area of fins located between the tubes of one of the adjacent heat exchangers and the tubes of the other heat exchanger in a specific manner, the manufacturing process is facilitated.

28 Claims, 6 Drawing Sheets

PARALLEL-DISPOSED INTEGRAL HEAT EXCHANGER

TECHNICAL FIELD

The present invention relates to a parallel integrated heat exchanger having a plurality of heat exchangers provided next to one another along the direction of air flow, in which the heat exchanging units of adjacent heat exchangers are linked together facing opposite each other. More specifically, it relates to a parallel integrated heat exchanger in which fins of adjacent heat exchangers are integrated.

BACKGROUND ART

The restrictions imposed with regard to available installation space in vehicles in recent years have necessitated a plurality of heat exchangers (e.g., a condenser and a radiator) fulfilling different functions to be integrated. Examples of such integrated heat exchangers include the structure disclosed in Japanese Unexamined Utility Model Publication No. H 2-14582.

In this integrated heat exchanger, a first heat exchanger and a second heat exchanger are provided in parallel and the fins of these heat exchangers are integrated to reduce the air flow resistance and the number of assembly steps. In addition, heat transfer prevention louvers are formed in the areas of the integrated fins located between the tubes of the first heat exchanger and the tubes of the second heat exchanger to lessen the degree to which heat exchangers affect the temperature of other heat exchangers.

The publication also discloses that the heat transfer prevention louvers formed at the fins are formed in a shape roughly identical to that of normal louvers located between the tubes of the heat exchangers and that the heat transfer prevention louvers are constituted of symmetrical louver groups, each having louvers distanced from the louvers of other groups, formed between a tube of the first heat exchanger and the corresponding tube in the second heat exchanger (see FIG. 1 of the publication).

However, it becomes difficult to manufacture the parallel integrated heat exchanger described above adopting a structure in which the heat transfer prevention louvers are symmetrically formed over a distance between the tubes of one of the plurality of heat exchangers adjacent to each other and the tubes of the heat exchangers if the heat exchangers installed in parallel need to be set closer to each other. In addition, it is not designed by taking into consideration how heat transfer prevention louvers, which will effectively prevent heat transfer, may be manufactured or how the process of manufacturing the louvers themselves is to be facilitated and, therefore, it cannot easily be put into practical use.

Accordingly, an object of the present invention is to provide a parallel integrated heat exchanger having a plurality of heat exchangers set in parallel and fins of adjacent heat exchangers integrated, which facilitates the production of heat transfer prevention louvers by forming the heat prevention transfer louvers in a particular manner and also achieves a full heat transfer prevention effect regardless of the distance between the parallel-set heat exchangers.

DISCLOSURE OF THE INVENTION

The parallel integrated heat exchanger according to the present invention, having a plurality of heat exchangers each having a heat exchanging unit constituted of fins and a plurality of tubes laminated via the fins and tanks provided along the direction in which the plurality of tubes are laminated, to communicate with the individual tubes, with adjacent heat exchangers joined with their heat exchanging units facing opposite each other and their fins formed as integrated common members, is characterized in that performance-improving louvers formed between the tubes of each of the heat exchangers and heat transfer prevention louvers formed over the entire area between the tubes of one of the adjacent heat exchangers and the tubes of the other heat exchanger are provided at the fins and that the heat transfer prevention louvers are formed continuously to, at least, performance-improving louvers formed at one of the heat exchangers.

The performance-improving louvers, which are formed in the areas between the tubes of the individual heat exchangers to promote the exchange of heat through enhanced exposure to the passing air, may be constituted as a single group or a plurality of groups of continuous louvers. In addition, the heat transfer prevention louvers, which are formed over the entire area between the tubes of one of the adjacent heat exchangers and the tubes of the other heat exchanger, are provided to reduce the degree of heat transfer that occurs from the heat exchanger on one side to the heat exchanger on the other side via the fins. The performance-improving louvers and the heat transfer prevention louvers may be constituted as inclining louvers that incline relative to the surfaces of the fins or as parallel louvers that lie parallel to the surfaces of the fins.

In addition, it is desirable to form the individual louvers formed continuously to one another in a uniform mode. Achieving a uniform formation mode means that when the fins are viewed from the side on which the louvers are formed, the heat transfer prevention louvers are formed in a pattern identical to the pattern of the performance-improving louvers, and when the heat transfer prevention louvers incline relative to the surfaces of the fins, for instance, the direction along which the heat transfer prevention louvers open and the direction along which the performance-improving louvers open must match (they must incline in a uniform direction). If the heat transfer prevention louvers are to be formed so that they project out parallel to the surfaces of the fins, on the other hand, the heat transfer prevention louvers must be made to project out continuously in a pattern identical to the pattern in which the performance-improving louvers are formed.

By assuming the structure described above, the exchange of heat between the air passing between the fins and the fluid flowing inside the tubes is promoted by the performance-improving louvers in the individual heat exchangers provided in parallel and the heat transfer prevention louvers prevent the adjacent heat exchangers from thermally affecting each other readily. In particular, since the heat transfer prevention louvers are formed over the entire area between the tubes of one of the adjacent heat exchangers and the tubes of the other heat exchanger, heat transfer can be inhibited with a high degree of reliability even when the distance between the adjacent heat exchangers is reduced. In addition, since the heat transfer prevention louvers are formed continuously to, at least, the performance-improving louvers formed at one of the heat exchangers and the individual louvers formed continuously adopt a uniform formation mode, it is not necessary to employ special processes when manufacturing the heat transfer prevention louvers.

In correspondence to the tube widths at the individual heat exchangers, the heat transfer prevention louvers adopting one of the following structures may be formed. First, if the tube widths of the adjacent heat exchangers are different, an even number of louver groups achieved by aligning roughly equal numbers of louvers along the direction in which the heat exchangers are provided in parallel (i.e., the direction of the width of the fins and the direction of the air flow) may be evenly formed in series at each fin. In other words, two or four louver groups may be serially formed along the direction of air flow.

In this structure, since the adjacent heat exchangers have different tube widths, the areas between the tubes at one of the heat exchangers and the tubes at the other heat exchanger are offset from the center of the width of the fins. In addition, since an even number of louver groups are evenly formed at each fin along the width of the fins, no louvers are formed at the centers of the fins along their width. As a result, louvers can be formed at areas corresponding to the areas of the fins located between the tubes at one heat exchanger and the tubes at the other heat exchanger.

Next, if the tube widths of the adjacent heat exchangers are roughly equal to each other, an odd number of louver groups achieved by aligning roughly equal numbers of louvers along the direction in which the heat exchangers are provided in parallel may be evenly formed in series at each fin. For instance, three louver groups may be serially formed along the direction of air flow.

In this structure, the areas between the tubes at one of the adjacent heat exchangers and the tubes at the other heat exchanger are each set at an approximate center along the width of the fins, and since an odd number of louver groups are evenly formed at the fins along the direction of their width, louvers are formed at the centers along the width of the fins. Thus, the areas at which the louvers are formed can be made to correspond to the areas of the fins located between the tubes at one heat exchanger and the tubes at the other heat exchanger.

Furthermore, the area between adjacent louver groups formed at a fin may be formed as a flat surface continuous with the surface of the fin, or as a non-flat surface by reducing the distance between the louver groups. A non-flat structure may be achieved by, for instance, forming a link portion with its peak shape between louver groups.

When the area between adjacent louver groups is formed as a flat portion, a smooth flow of air guided by the louvers to pass between the fins is achieved in an effective manner, whereas when the area between adjacent louver groups is formed as a smaller non-flat portion, an improvement in heat exchanging performance is achieved, since the ratio of the area on the fin surface occupied by the louvers is increased.

THE BEST MODE FOR CARRYING OUT THE INVENTION

Figure 1A:
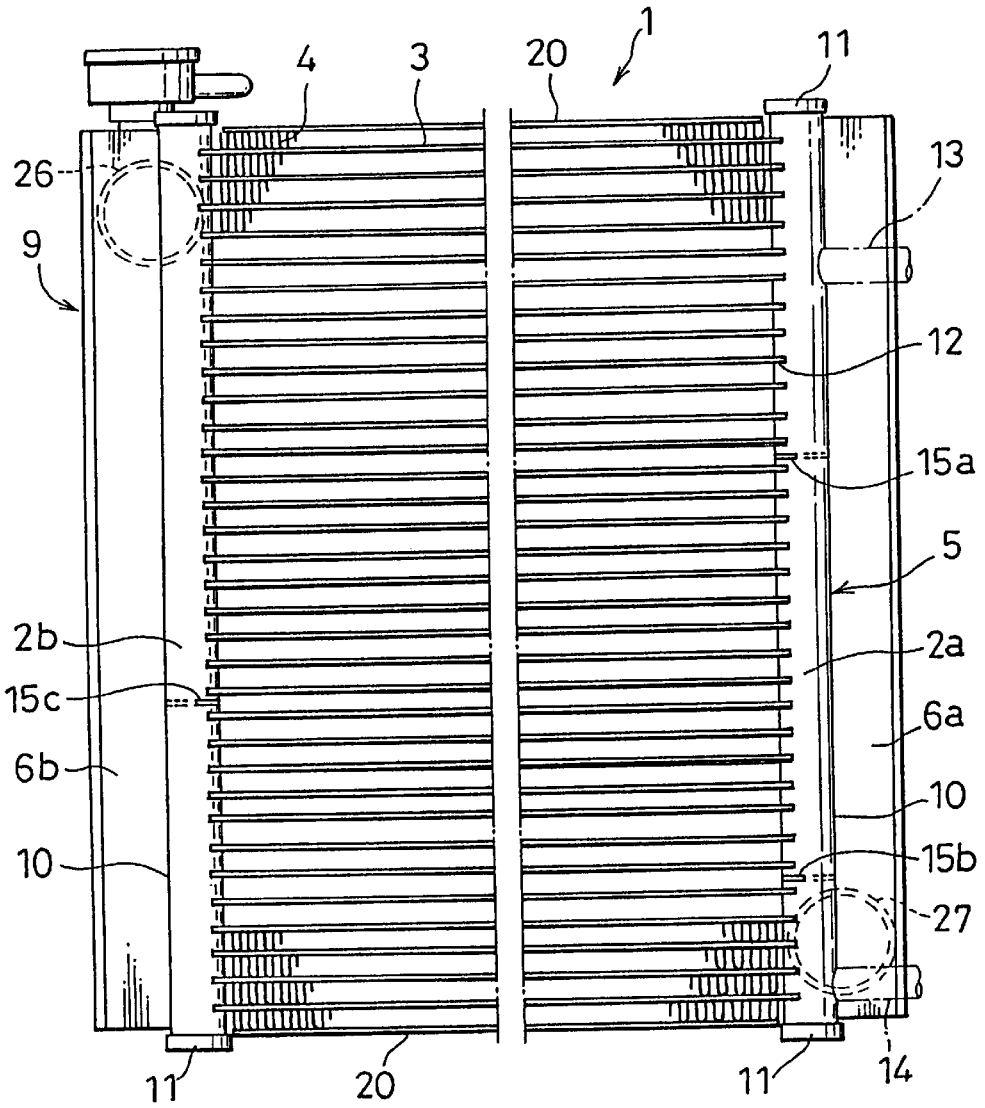
FIGS. 1(*a*) and 1(*b*) illustrate the overall structure of the parallel integrated heat exchanger according to the present invention, with FIG. 1(*a*) presenting its front view and FIG. 1(*b*) presenting its plan view.
Figure 1B:
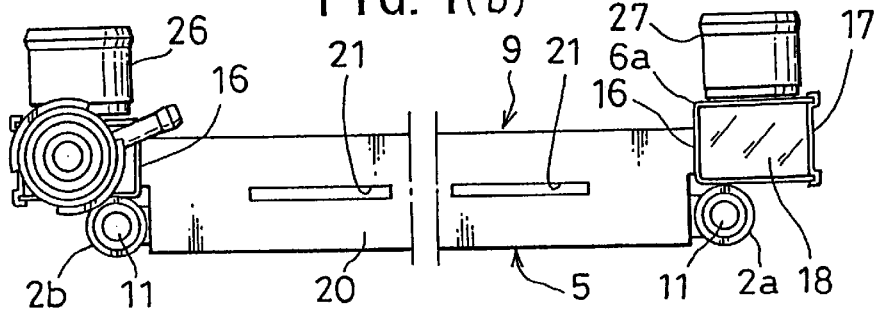
Figure 2:
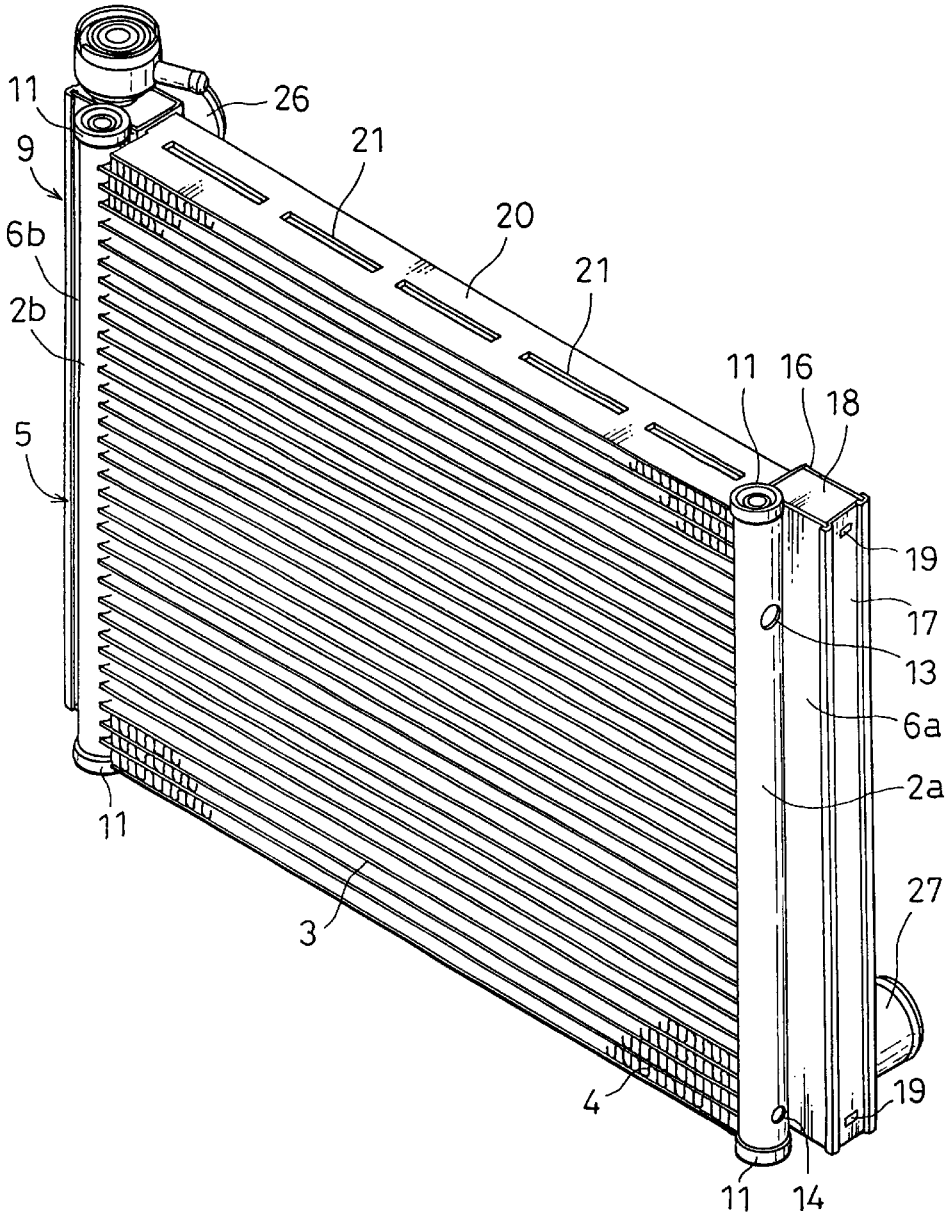
FIG. 2 is a perspective if the parallel integrated heat exchanger in FIGS. 1(*a*) and 1(*b*)
Figure 3:
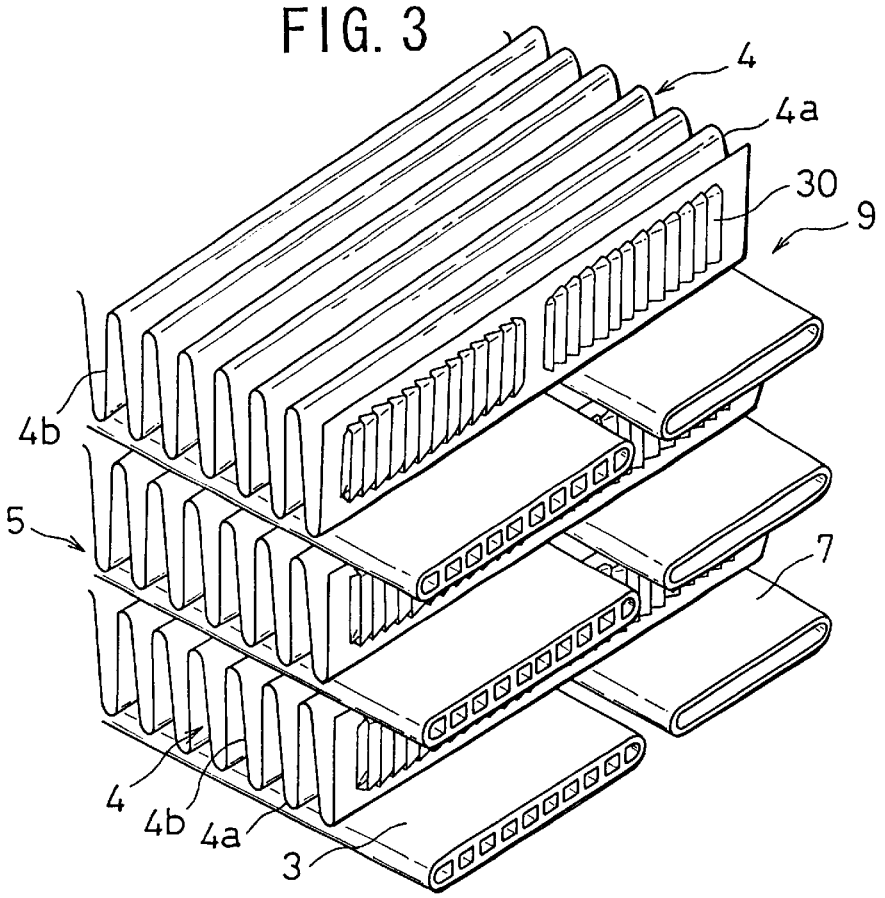
FIG. 3 is an enlarged perspective of the tubes of the individual heat exchangers and the fins in the parallel integrated heat exchanger according to the present invention.

The following is an explanation of embodiments of the present invention, given in reference to the drawings. In FIGS. 1(*a*) through 3, a parallel integrate heat exchanger 1 achieved by joining a condenser 5 and a radiator 9 as one unit is constituted of an aluminum alloy. The condenser 5 comprises a pair of tanks 2*a* and 2*b*, a plurality of flat tubes 3 communicating between the pair of tanks 2*a* and 2*b* and corrugated fins 4 inserted and bonded between the individual tubes 3. The radiator 9 comprises a pair of tanks 6*a* and 6*b* formed separately from the tanks at the condenser, a plurality of flat tubes 7 communicating between the pair of tanks and formed separately from the tubes 3 at the condenser and fins 4 also constituting the fins of the condenser 5 and inserted and bonded between the individual tubes 7.

In the individual heat exchangers 5 and 9, the plurality of tubes 3 and 7 and the fins 4 constitute heat exchanging units that perform heat exchange for fluid flowing inside the tubes and the air passing between the fins, and the individual heat exchanging units facing opposite each other are assembled to achieve an integrated state.

The tubes 3 of the condenser 5, which adopts a structure of the known art achieved by partitioning the internal space with numerous ribs to improve the strength, may be formed through extrusion molding. In addition, the tanks 2*a* and 2*b* of the condenser 5 are each formed by blocking the openings at the two ends of a cylinder member 10 with lids 11, with a plurality of tube insertion holes 12 at which the tubes 3 are inserted at the circumferential wall of the cylinder member 10, and their internal space partitioned by partitioning walls 15*a*, 15*b*, and 15*c* to form a plurality of low passage chambers. An intake port 13 through which the coolant flows in is provided at a position located at the portion of the tank constituting the most upstream side flow passage chamber and an outlet port 14 through which the coolant flows out is provided at a position located at the portion of the tank constituting the most downstream side flow passage chamber.

The structural example shown in FIGS. 1(*a*) and 1(*b*), one of the tanks, i.e., the tank 2*a*, is divided into three flow passage chambers by the two partitioning walls 15*a* and 15*b*, the other tank 2*b* is divided into two flow passage chambers by one partitioning wall 15*c*, and the intake port 13 and the outlet port 14 are provided at the tank 2*a* to allow the coolant having flowed in through the intake port 13 to travel between the tanks twice before flowing out through the outlet port 14.

The tubes 7 of the radiator 9, on the other hand, are constituted of electro-resistance-welded tubes with no ribs partitioning the internal space. In addition, the tanks 6*a* and 6*b* of the radiator 9 each assume a cylindrical shape with a rectangular cross section, constituted of a first tank member 16 having tube insertion holes at which the tubes 7 are inserted therein and achieving a U-shaped cross section and a second tank member 17 set between the sidewalls of the first tank member 16 to constitute a circumferential wall of the tank 6 together with the first tank member 16, with the openings at the two ends of the cylindrical body closed off with a blocking plates 18.

The blocking plates 18 are each constituted of a flat plate formed in a rectangular shape in conformance to the cross sectional shape of the tank and having projections formed at two sides thereof facing opposite each other so that they are mounted at the openings of the cylindrical body by fitting the projections at fitting holes 19 formed at the first tank member 16 and the second tank member 17.

Retaining grooves are formed at the second tank member 17 by distending and bending the two side edges into a U-shape, and the tank member 16 and 17 are joined with each other by fitting the sidewall ends of the first tank member 16 at the retaining grooves. The first tank member 16 and the second tank member 17 are joined with each other at a position distanced from the side at which the tubes 7 are connected, further outward relative to the position at which the tank 6 faces opposite the tank 2 of the condenser 5.

At one of the tanks of the radiator 9, i.e., the tank 6*b*, an intake port 26 through which the fluid flows in is provided, and an outlet port 27 through which the fluid flows out is provided at the other tank 6*a*. In this example, the internal spaces at both tanks 6*a* and 6*b* are not partitioned, so that the fluid having flowed in through the intake port 26 is allowed to travel from the tank 6*b* to the other tank 6*a* via all the tubes 7 before it flows out through the outlet port 27.

Further outward relative to the laminated tubes 3 and 7 (at the upper and lower ends of the heat exchanging units in FIG. 1(*a*), side plates 20 are brazed via the fins 4 and the condenser 5 and the radiator 9 are joined as a single unit by the side plates 20. The side plates 20 may each be constituted of a single plate shared by the two heat exchangers, with at least one ventilation hole 21 formed at the plate surface at a position facing opposite the area between the condenser 5 and the radiator 9.

The at least one ventilation hole 21 is formed as an elongated hole extending along the direction of the length of the side plate 20, and it communicates between the area between the condenser 5 and the radiator 9 and the outside, thereby ensuring that heat radiation from the condenser 5 is not hindered by air at a relatively high temperature stagnating between the condenser 5 provided on the upstream side and the radiator 9 provided on the downstream side when the heat exchanger is operating at a low air velocity and promoting heat radiation from the radiator 9 by directly guiding air at a relatively low temperature flowing in via the ventilation hole 21 to the radiator 9.

In addition, as illustrated in FIG. 1(*b*), the side plates 20 are not bonded with the tanks 2*a* and 2*b* on the condenser side but are set away from them over a specific distance, and are brazed to the tanks 6*a* and 6*b* on the radiator side. The side plates 20 and the tanks 6*a* and 6*b* may be bonded through brazing simply by placing the two ends of each side plate 20 in contact with the surfaces of the first tank member 16 or they may be brazed with the ends of the side plates 20 inserted at insertion holes formed at the first tank member 16.

In this example, the condenser 5 and the radiator 9 are joined to form an integrated unit by the side plates 20 and the fins 4 formed to be shared by the two heat exchangers, and the tanks 2*a* and 2*b* of the condenser 5 and the tanks 6*a* and 6*b* of the radiator 9 are assembled in a separated state.

Figure 4:
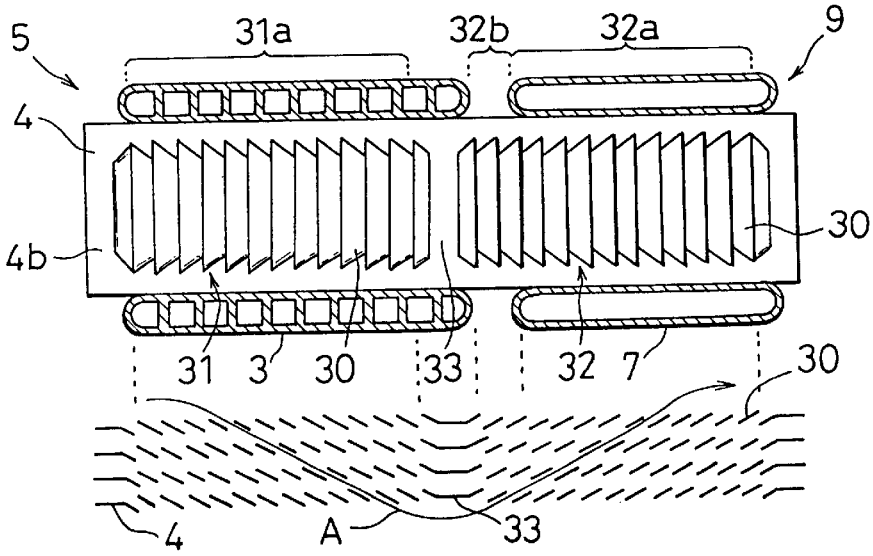
FIG. 4 shows the positional relationship between the tubes at the individual heat exchangers and the louvers at the fins in the parallel integrated heat exchanger according to the present invention, achieved when the tube width at the condenser is larger than the tube width at the radiator and two louver groups are evenly formed at the fins. The upper section of FIG. 4 is a sectional view of a portion obtained by cutting the fins and the tubes along the direction of the width of the fins, and the lower section of FIG. 4 illustrates the configuration of louvers at the fins.

The fins 4 are each constituted by continuously forming bent apical portions 4*a* and flat portions 4*b* located between the apical portions along the direction of the length of the tubes, and as shown in FIG. 4, louvers 30 are formed at each of the flat portions 4*b*. The louvers 30 each rise at an incline relative to the surface of the flat portions 4*b* and project out to the front side and to the rear side, so that air passing between the fins is guided by the louvers to pass through the flat portions 4*b*.

Such louvers 30 are formed continuously to constitute a louver group and, in this example, two louver groups, i.e., a first louver group 31 and a second louver group 32 are provided in series along the direction of the width of the fin 4 (i.e., the direction along which the condenser and the radiator are provided in parallel). Each louver group is constituted by aligning a plurality of uniformly shaped louvers which are continuously formed and inclined along the same direction, and the first louver group 31 and the second louver group 32 are formed symmetrically to each other relative to the center of the fin width. In addition, a flat portion 33 where no louver is present is formed between the first louver group 31 and the second louver group 32.

The width of the tubes at the condenser 5 is set larger than the width of the tubes at the radiator 9, the flat portions 33 are formed in the area located between the tubes of the condenser 5 and louvers constituting the second louver group 32 are formed at the fins 4 in the area located between the tubes 3 of the condenser 5 and the tubes 7 of the radiator 9. In other words, the second louver group 32 is constituted by continuously forming performance-improving louvers 32*a* located between the tubes of the radiator 9 and heat transfer prevention louvers 32*b* located between the tube 3 of the condenser 5 and the tube 7 of the radiator 9, with a portion of the second louver group 32 utilized to constitute heat transfer prevention louvers. All the louvers 30 in the first louver group 31, on the other hand, are constituted as performance-improving louvers 31*a*.

When assembling the parallel integrated heat exchanger structured as described above, the first tank member 16 and the second tank member 17 are assembled together and, at the same time, the blocking plates 18 are mounted by fitting them at the fitting holes 19 of the tank member 16 and 17 to form the tanks 6*a* and 6*b* of the radiator 9. Then, the tubes 3 and 7 are respectively inserted at the pair of tanks 2*a* and 2*b* and the pair of tanks 6*a* and 6*b* of the condenser 5 and the radiator 9, the common fins 4 are mounted between the individual tubes and the side plates 20 are mounted via the fins further toward the outside of the laminated tubes 3 and 7.

The individual heat exchangers 5 and 9 thus assembled are fixed by using a jig in a state in which their heat exchanging units are set opposite each other in parallel and the areas over which the tanks 2*a* and 2*b* of the condenser 5 and the tanks 6*a* and 6*b* of the radiator 9 are joined with the tubes 3 and 7 respectively are set aligned along the lateral direction over a small distance from each other. Then, the entire assembly is brazed in a furnace to connect the condenser 5 and the radiator 9 as a unit via the side plates 20 and the fins 4.

The integrated heat exchanger thus achieved is mounted with the condenser 5 set on the upwind side. A high-temperature, high-pressure coolant flows into the condenser 5 from the compressor (not shown), and this coolant undergoes heat exchange with the air passing through the fins 4 while it travels through the tubes 3. In addition, the engine cooling water flows into the radiator 9, and the cooling water undergoes heat exchange with the air passing through the fins 4 while it travels through the tubes 7.

Since the performance-improving louvers 31*a* and 32*a* are formed at the fins 4 between the tubes of the individual heat exchangers, the fluid flowing through the tubes undergoes heat exchange with the air passing between the fins with a high degree of efficiency. While it is not possible to completely eliminate the thermal interference via the fins since the temperature of the fluid flowing inside the tubes of the radiator 9 becomes higher than the temperature of the fluid flowing inside the tubes of the condenser 5, the heat transfer from the radiator to the condenser can be reduced to a satisfactory degree because of the heat transfer prevention louvers 32*b* formed at the fins 4 over the entire area between the tubes 3 of the condenser 5 and the tubes 7 of the radiator 9.

As described above, since the heat transfer prevention louvers 32*b* are formed continuously to the performance-improving louvers 32*a* and the heat transfer prevention louvers 32*b* are provided over the entire area between the tubes 3 of the condenser 5 and the tubes 7 of the radiator 9, a satisfactory heat transfer prevention effect is achieved regardless of the distance between the tubes 3 of the condenser 5 and the tubes 7 of the radiator 9.

Figure 5:
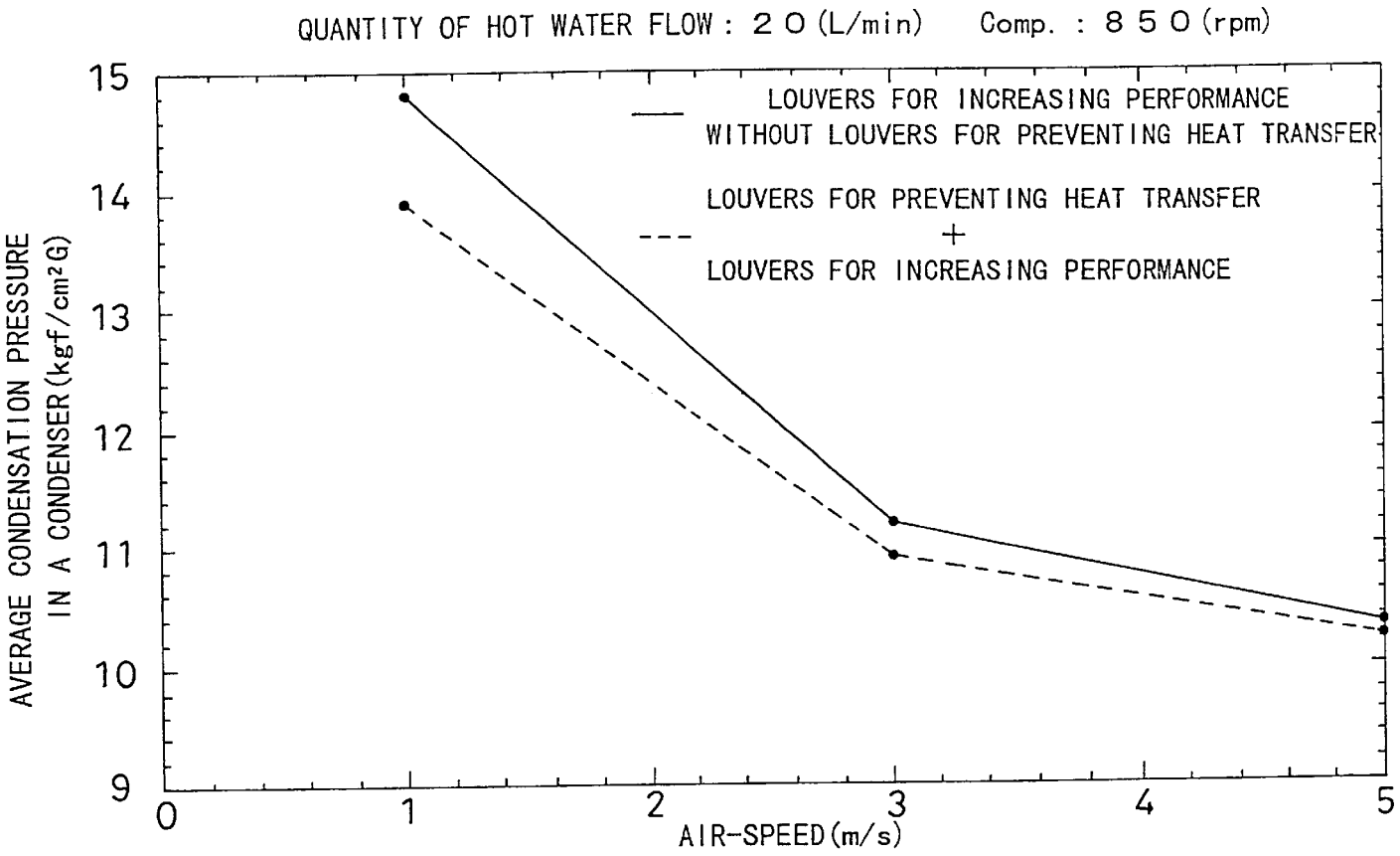
FIG. 5 presents a characteristics diagram showing the condenser heat exchanging performance measured in the parallel integrated heat exchanger according to the present invention provided with the heat transfer prevention louvers and in a heat exchanger without any heat transfer prevention louvers.

FIG. 5 shows the results of a test conducted to prove this point. Based upon the results presented in the figure, the effect of the heat from the radiator 9 can be evaluated in correspondence to the coolant average pressure at the condenser 5 since there is a correlation between the degree is of effect of the heat transmitted from the radiator 9 to the condenser 5 and the coolant average pressure at the condenser 5 in which even when the air velocity is constant, the coolant average pressure at the condenser 5 increases as the effect of the heat transmitted from the radiator 9 to the condenser 5 increases, whereas the coolant average pressure at the condenser 5 becomes reduced as the effect of the heat from the radiator 9 decreases. The results in FIG. 5 were obtained through measurement of the coolant average pressure at the condenser 5 performed by continuously supplying warm water at a constant temperature (90° C.) at a constant flow rate (20 L/ min) to the radiator 9 and concurrently operating the compressor in the air conditioning cycle at a specific rotating rate (850 rpm) at varying air velocities. In the figure, the solid line represents measurement results obtained in an integrated heat exchanger having the fins 4 of the condenser and the radiator constituted as a common member, which is provided only with performance-improving louvers but with no heat transfer prevention louvers, and the one-point chain line represents the results achieved in the integrated heat exchanger described above provided with the heat transfer prevention louvers formed over the entire area between the tubes 3 of the condenser 5 and the tubes 7 of the radiator 9 in addition to the performance-improving louvers.

As the results of the test clearly demonstrate, the integrated heat exchanger 1 adopting the structure described above, which is provided with the heat transfer prevention louvers 32*b*, is capable of reducing the effect of heat transfer compared to an integrated heat exchanger without such heat transfer prevention louvers and this advantage is realized fully in the low air velocity range in particular. The effect of the heat transfer prevention louvers becomes lessened in the high air velocity range, since the two heat exchangers achieve full heat exchanging performance at high air flow rates, the effect of heat transfer becomes almost insignificant and, as a result, the effect of the heat transfer prevention louvers 32*b* becomes less pronounced.

Since the heat transfer prevention louvers 32*b* and the performance-improving louvers 32*a* are formed continuously in the structural example explained above, they can be formed without having to distinguish them from each other according to their functions during the manufacturing process. In particular, since the two louver groups 31 and 32 are formed symmetrically to each other in this structure, the design and production processes are facilitated. In addition, since there is no risk of erroneous assembly of fins, an improvement in the production efficiency is realized. Furthermore, with the louver groups 31 and 32 formed symmetrically to each other, good air flow, such as that indicated by the arrow A in FIG. 4, is achieved.

Figure 6:
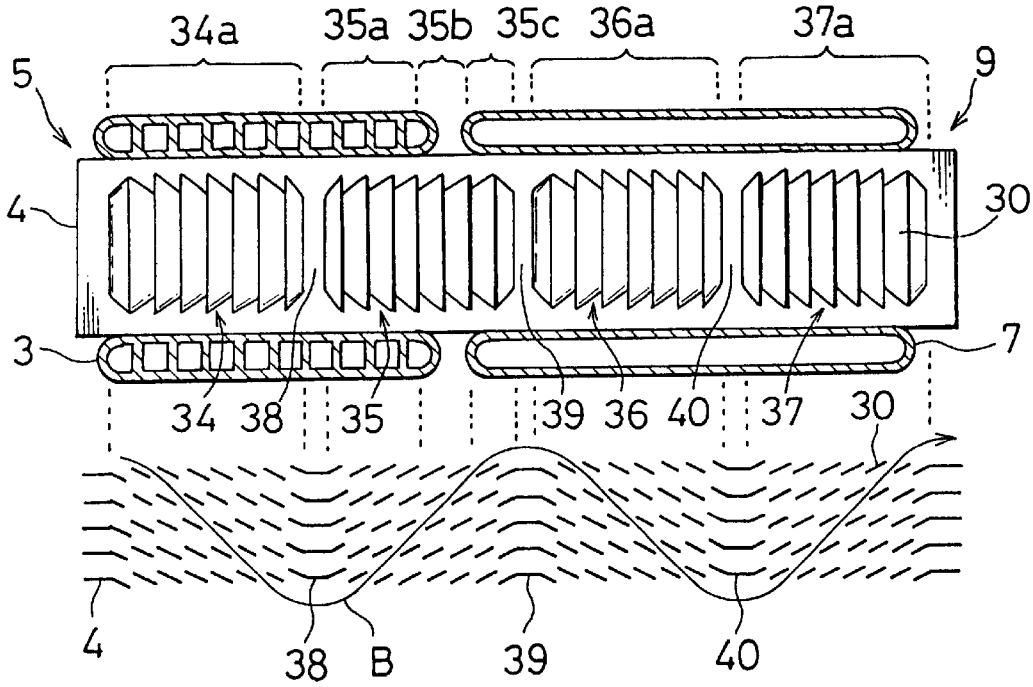
FIG. 6 shows the positional relationship between the tubes at the individual heat exchangers and of the louvers at the fins in the parallel integrated heat exchanger according to the present invention, achieved when the tube width at the radiator is larger than the tube width at the condenser and four louver groups are evenly formed at each fin. The upper section of FIG. 6 is a sectional view of a portion obtained by cutting the fins and the corresponding tubes along the direction of the width of the fins, and the lower section of FIG. 6 illustrates the configuration of louvers at the fins.

FIG. 6 shows another example of the relationship that may be assumed by the louvers 30 at the fins 4 and the individual tubes 3 and 7, and in this example, the tube width at the radiator 9 is set larger than the width of the tubes at the condenser 5. In addition, four louver groups, i.e., first~fourth louver groups 34~37, are formed in series along the direction of the width of the fins 4 (the direction of air flow), with the individual louvers constituting the first and third louver groups 34 and 36 aligned along the same inclining direction, and the individual louvers constituting the second and fourth louver groups 35 and 37 aligned along the direction opposite from the inclining direction of the first and third louver groups.

The louver groups are all constituted of equal numbers of louvers 30 and the individual louver groups 30 are set evenly over uniform intervals. First~third flat portions 38~40 are formed in the area between the first louver group 34 and the second louver group 35, the area between the second louver group 35 and the third louver group 36 and the area between the third louver group 36 and the fourth louver group 37, with the first flat portion 38 formed over an area located between the tubes 3 of the condenser 5, the second and third flat portions 39 and 40 formed over an area located between the tubes 7 of the radiator 9 and louvers constituting the second louver group 35 formed at the fins over the area located between the tubes 3 of the condenser 5 and the tubes 7 of the radiator 9.

In other words, the second louver group 35 is constituted by continuously forming performance-improving louvers 35*a* located between the tubes of the condenser 5, heat transfer prevention louvers 35*b* located between the first louver group and the second louver group and performance-improving louvers 35*c* located between the tubes of the radiator 9 and, in this example, a portion of the second louver group 35 is utilized as the heat transfer prevention louvers 35*b* with the performance-improving louvers 35*a* and 35*c* and the heat transfer prevention louvers 35*b* inclining along the same direction. In addition, all the louvers 30 in the first, third and fourth louver groups 34, 36 and 37 constitute performance-improving louvers 34*a*, 36*a* and 37*a* respectively.

When this structure is adopted, too, since the heat transfer prevention louvers 35*b* are formed over the entire area between the tubes 3 of the condenser 5 and the tubes 7 of the radiator 9, the heat transfer from the radiator to the condenser can be reduced to a satisfactory degree, to achieve an advantage comparable to that indicated in the characteristics diagram in FIG. 5. In addition, since the heat transfer prevention louvers 35*b* are formed continuously to the performance-improving louvers 35*a* and 35*c*, it is not necessary to distinguish between them during the manufacturing process and especially in this example in which four louver groups are evenly formed, no particular consideration needs to be taken when forming louvers and there is no risk of erroneous assembly of the fins. Furthermore, since the adjacent louver groups are formed symmetrically to each other, good air flow, such as that indicated by the arrow B in FIG. 6, is achieved for the air guided by the louvers.

FIGS. 7 through 10 present other examples of the relationship that may be assumed by the louvers 30 at the fins 4 and the tubes 3 and 7, and in these examples, the width of the tubes at the condenser 5 and the width of the tubes at the radiator 9 are set equal to each other.

Figure 7:
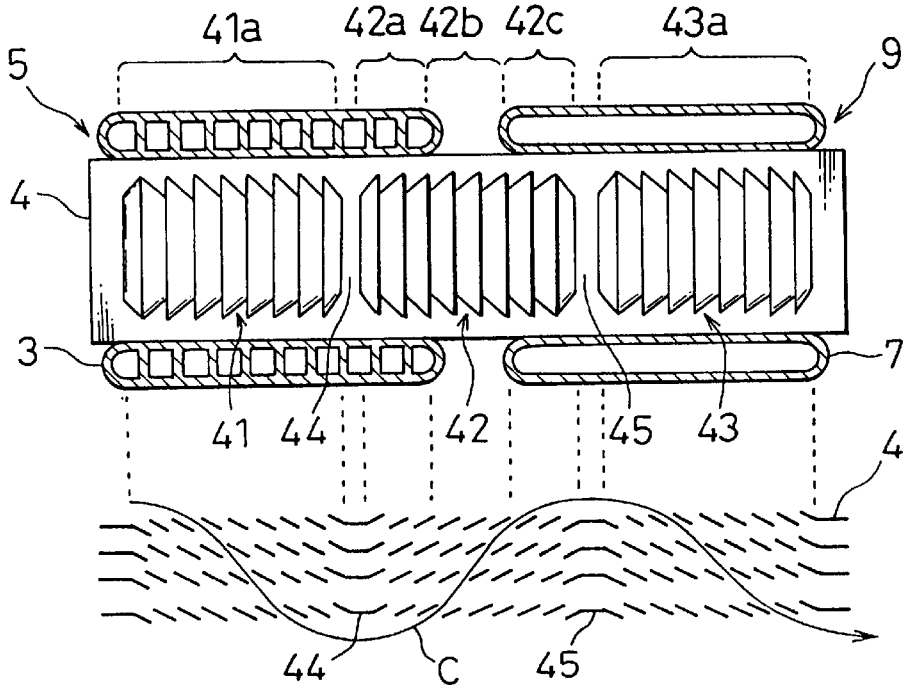
FIG. 7 shows the positional relationship between the tubes at the individual heat exchangers and the louvers at the fins in the parallel integrated heat exchanger according to the present invention, achieved when the tube width at the radiator is set roughly equal to the tube width at the condenser and three louver groups are evenly formed at each fin. The upper section of FIG. 7 is a sectional view of a portion obtained by cutting the fins and the corresponding tubes along the direction of the width of the fins, and the lower section of FIG. 7 illustrates the configuration of louvers at the fins.

The structure shown in FIG. 7 is achieved by forming three louver groups, i.e. first through third louver groups 41~43 in series along the direction of the width of the fin (the direction of the air flow), with the individual louvers constituting the first and third louver groups 41 and 43 aligned along the same inclining direction and the individual louvers constituting the second louver group 42 aligned along an inclining direction which is opposite from the inclining direction of the first and third louver groups 41 and 43.

The individual louver groups are constituted of equal numbers of louvers and are set evenly over uniform intervals. First and second flat portions 44 and 45 are formed in the area between the first louver group 41 and the second louver group 42 and the area between the second louver group 42 and the third louver group 43, with the first flat portion 44 formed over an area between the tubes 3 of the condenser 5, the second flat portion 45 formed over an area located between the tubes 7 of the radiator 9 and louvers constituting the second louver group 42 formed at the fins 4 located between the tubes 3 of the condenser 5 and the tubes 7 of the radiator 9.

In other words, in the second louver group 42, performance-improving louvers 42*a* and 42*c* located between the tubes of the condenser 5 and between the tubes of the radiator 9 are formed on two sides, heat transfer prevention louvers 42*b* located between the tubes 3 of the condenser 5 and the tubes 7 of the radiator 9 are formed in the middle and the performance-improving louvers 42*a* and 42*c* and the heat transfer prevention louvers 42*b* are formed continuously. In addition, all the louvers 30 in the first and third louver groups 41 and 43 are constituted as performance-improving louvers 41*a* and 43*a* respectively.

When this structure is adopted, too, since the heat transfer prevention louvers 42*b* are formed over the entire area between the tubes 3 of the condenser 5 and the tubes 7 of the radiator 9, the heat transfer from the radiator to the condenser can be reduced to a satisfactory degree, to achieve an advantage comparable to that indicated in the characteristics diagram in FIG. 5. In addition, since the heat transfer prevention louvers 42*b* are formed continuously to the performance-improving louvers 42*a* and 42*c*, no particular consideration needs to be taken when forming louvers and, since the three louver groups are evenly formed, louver formation is facilitated and there is no risk of erroneous assembly. Furthermore, since the adjacent louver groups are formed symmetrically to each other, good air flow, such as that indicated by the arrow C in FIG. 7, is achieved for the air guided by the louvers 30.

Figure 8:
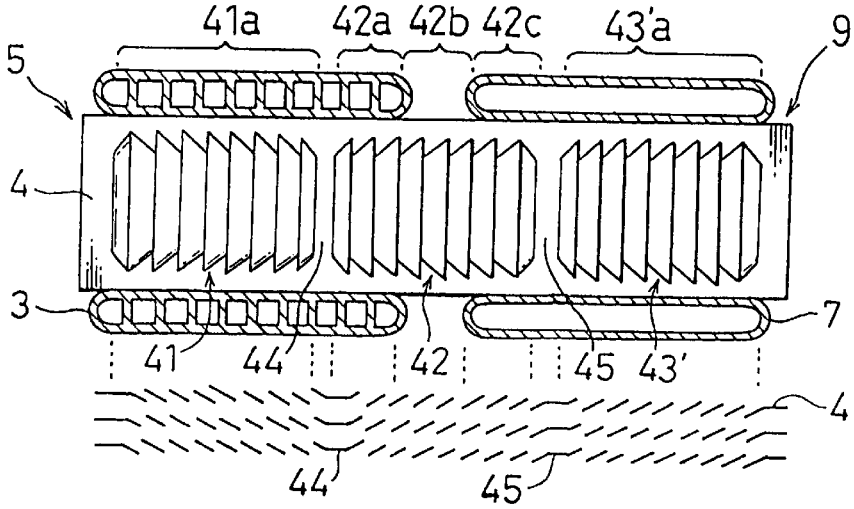
FIG. 8 shows the positional relationship between the tubes at the individual heat exchangers and of the louvers at the fins in the parallel integrated heat exchanger according to the present invention, presenting another example in which the tube width at the radiator is set roughly equal to the tube width at the condenser and three louver groups are evenly formed at each fin. The upper section of FIG. 8 is a sectional view of a portion obtained by cutting the fins and the tubes along the direction of the width of the fins, and the lower section of FIG. 4 illustrates the configuration of louvers at the fins.

The structure shown in FIG. 8 is achieved by inclining the louvers constituting the third louver group 43 in FIG. 7 in the opposite direction. While the air does not flow in the serpentine pattern indicated by the arrow C in FIG. 7 in this structure in which the third louver group 43' is not formed to achieve symmetry with the second louver group 42, the heat transfer prevention louvers 42*b* are formed over the entire area between the tube 3 of the condenser 5 and the tube 7 of the radiator 9 to achieve advantages over the prior art in that the heat transfer from the radiator to the condenser is greatly reduced, in that characteristics that are comparable to those shown in FIG. 5 are achieved and in that the heat transfer prevention louvers 42*b* and the performance improving louvers 42*a* and 42*c* are formed continuously to eliminate the necessity for distinguishing them from each other during the manufacturing process.

Figure 9:
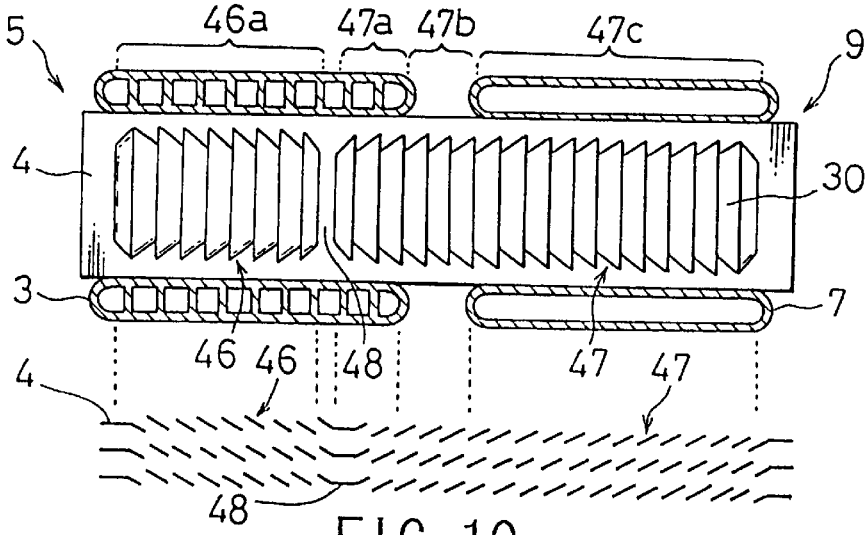
FIG. 9 shows the positional relationship between the tubes at the individual heat exchangers and the louvers at the fins in the parallel integrated heat exchanger according to the present invention, achieved when the tube width at the radiator is set roughly equal to the tube width at the condenser and two louver groups are formed with one louver group having a larger number of louvers than the other at each fin. The upper section of FIG. 9 is a sectional view of a portion obtained by cutting the fins and the corresponding tubes along the direction of the width of the fins, and the lower section of FIG. 9 illustrates the configuration of louvers formed at the fins.

The structure in FIG. 9 is achieved by forming two louver groups, a first louver group 46 and a second louver group 47, in series at each flat portion along the direction of the width of the fins (the direction of air flow) and forming the second louver group 42 and the third louver group 43' in FIG. 8 continuously to each other to constitute the second louver group 47.

Namely, a flat portion 48 is formed between the first louver group 46 and the second louver group 47 at a position between the tubes of the condenser 5, and in the second louver group 47, performance-improving louvers 47*a* located between the tubes of the condenser 5, heat transfer prevention louvers 47*b* located between the tube 3 of the condenser 5 and the tube 7 of the radiator 9 and performance-improving louvers 47*c* located between the tubes 7 of the radiator 9 are formed continuously. In addition, all the louvers 30 in the first louver group 46 are constituted as performance-improving louvers 46*a*.

As in the structure shown in FIG. 8, the air does not flow in a serpentine pattern in this structure, either. However, it achieves an advantage in that since no flat portion is present in the area where the air does not readily move in a serpentine pattern, the number of performance-improving louvers is increased over this area to improve the heat exchanging performance.

Figure 10:
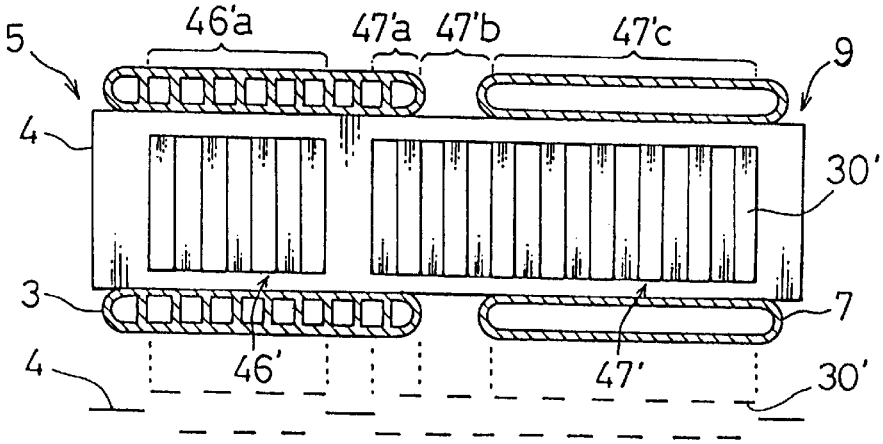
FIG. 10 shows the positional relationship between the tubes at the individual heat exchangers and the louvers at the fins in the parallel integrated heat exchanger according to the present invention, achieved when the tube width at the radiator is set roughly equal to the tube width at the condenser and the louvers at the fins are formed as parallel louvers. The upper section of FIG. 10 is a sectional view of a portion obtained by cutting the fins and the tubes along the direction of the width of the fins, and the lower section of FIG. 10 illustrates the configuration of louvers formed at the fins.

In the structure shown in FIG. 10, first and second louver groups 46' and 47' formed at a fin are both constituted of parallel louvers 30' lying parallel with the surface of the fin instead of the inclined louvers shown in FIG. 9. The parallel louvers 30' are formed to alternately project out to the front side and the rear side of the fin 4, and contribute to an improvement in the heat exchanging performance over the areas where the performance-improving louvers 46'*a,* 47'*a* and 47'*c* are formed by ensuring a smooth airflow effectively blocking heat transfer over the area where heat transfer prevention louvers 47'*b* are formed.

Other structural features in FIGS. 6~10 are identical to those adopted in the structure illustrated in FIGS. 1~4, and the same reference numbers are assigned to identical components to preclude the necessity for repeated explanation thereof In addition, the manner in which the tubes and the louvers should be provided in combination with each other is not limited to the examples explained above and the structures explained above may be combined as appropriate as long as the heat transfer prevention louvers continuous to the performance-improving louvers are formed at the fins over the area between the tubes 3 of the condenser 5 and the tubes 7 of the radiator 9.

INDUSTRIAL APPLICABILITY

As described above, in the parallel integrated heat exchanger having common fins shared by adjacent heat exchangers according to the present invention, heat transfer prevention louvers are formed over the entire area between the tubes of one of the adjacent heat exchangers and the tubes of the other heat exchanger, with these louvers formed continuous to, at least, performance-improving louvers located between the tubes of one of the heat exchangers and, as a result, the degree to which the adjacent heat exchangers affect each other thermally can be reduced by the heat transfer prevention louvers.

In particular, since the heat transfer prevention louvers are formed over the entire area between the tubes of one of the adjacent heat exchangers and the tubes of the other heat exchanger, a sufficient degree of reduction in heat transfer is assured even when the heat exchangers provided in parallel are set over a smaller distance from each other. In addition, by forming the heat transfer prevention louvers continuous to, at least, the performance-improving louvers formed at one of the heat exchangers and by achieving a uniform formation mode for the individual louvers continuously formed in this manner, no special consideration needs to be taken in the production of the heat transfer prevention louvers to facilitate the manufacturing process.

Furthermore, by evenly forming an even number of louver groups achieved by aligning roughly equal numbers of louvers in series along the direction of the width of the fins when the widths of the tubes of the adjacent heat exchangers are different from each other, or by evenly forming an odd number of louver groups achieved by aligning roughly equal numbers of louvers in series along the direction of the width of the fins when the widths of the tubes of the adjacent heat exchangers are roughly equal to each other, a louver formation area can be made to correspond to the area of the fins located between the tubes of one of the adjacent heat exchangers and the tubes of the other heat exchanger. Since this structure requires louver groups with roughly equal numbers of louvers to be formed over uniform intervals at the fins, the manufacturing process is facilitated, and in addition, the heat exchanging performance can be improved by achieving good air flow.

Furthermore, by forming the area between adjacent louver groups formed at the fins as a flat area continuous to the fin surface, a smooth flow of air passing between the fins is assured, whereas by reducing the distance between adjacent louver groups and forming the area between the louver groups as a non-flat surface, the ratio of the area occupied by the louvers at the fin surface can be increased to improve the heat exchanging performance.

What is claimed is:

1. A parallel integrated heat exchanger having a plurality of heat exchangers, each provided with a heat exchanging unit constituted with fins and a plurality of tubes laminated via said fins and tanks communicating with said plurality of tubes, with adjacent heat exchangers joined by having said heat exchanging units thereof facing opposite each other and fins of said adjacent heat exchangers formed as an integrated common member, wherein performance-improving louvers are formed between said tubes of said heat exchangers at said fins, and heat transfer prevention louvers are formed continuously along an area spanning a distance between said tubes of said adjacent heat exchangers at said fins, said heat transfer prevention louvers are formed continuous with, at least, said performance-improving louvers of one of said adjacent heat exchangers, wherein said tubes widths at said adjacent heat exchangers are different from each other, and an even number of louver groups are achieved by aligning roughly equal numbers of louvers evenly in series along said fins in a direction in which said adjacent heat exchangers are provided in parallel at said fins.

2. A parallel integrated heat exchanger according to claim 1, wherein a uniform formation mode is adopted to continuously form said heat transfer prevention louvers in an identical pattern with said performance-improving louvers.

3. A parallel integrated heat exchanger according to claim 1, wherein a flat surface is formed between adjacent louver groups.

4. A parallel integrated heat exchanger according to claim 1, wherein a non-flat surface is formed by reducing the distance between adjacent louver groups.

5. A parallel integrated heat exchanger according to claim 1, wherein said louvers are inclined louvers inclining relative to the surfaces of said fins at which said louvers are formed.

6. A parallel integrated heat exchanger according to claim 3, wherein said louvers are inclined louvers inclining relative to the surfaces of said fins at which said louvers are formed.

7. A parallel integrated heat exchanger according to claim 4, wherein said louvers are inclined louvers inclining relative to the surfaces of said fins at which said louvers are formed.

8. A parallel integrated heat exchanger according to claim 2, wherein said louvers are parallel louvers lying parallel to the surfaces of said fins at which said louvers are formed.

9. A parallel integrated heat exchanger according to claim 1, wherein said louvers are parallel louvers lying parallel to the surfaces of said fins at which said louvers are formed.

10. A parallel integrated heat exchanger according to claim 3, wherein said louvers are parallel louvers lying parallel to the surfaces of said fins at which said louvers are formed.

11. A parallel integrated heat exchanger according to claim 4, wherein said louvers are parallel louvers lying parallel to the surfaces of said fins at which said louvers are formed.

12. A parallel integrated heat exchanger according to claim 1, further comprising a condenser and a radiator joined as one unit to form said parallel integrated heat exchanger.

13. A parallel integrated heat exchanger according to claim 12, wherein said condenser comprises a first pair of said tanks and said radiator comprises a second pair of said tanks.

14. A parallel integrated heat exchanger according to claim 13, wherein said condenser further comprises a plurality of said tubes communicating between said first pair of said tanks.

15. A parallel integrated heat exchanger according to claim 13, wherein said radiator further comprises a plurality of said tubes communicating between said second pair of said tanks and formed separately from said tubes of said condenser.

16. A parallel integrated heat exchanger having a plurality of heat exchangers, each provided with a heat exchanging unit constituted with fins and a plurality of tubes laminated via said fins and tanks communicating with said plurality of tubes, with adjacent heat exchangers joined by having said heat exchanging units thereof facing opposite each other and fins of said adjacent heat exchangers formed as an integrated common member, wherein performance-improving louvers are formed between said tubes of said heat exchangers at said fins, and heat transfer prevention louvers are formed continuously along an area spanning a distance between said tubes of said adjacent heat exchangers at said fins, said heat transfer prevention louvers are formed continuous with, at least, said performance-improving louvers of one of said adjacent heat exchangers, wherein said tubes widths at said adjacent heat exchangers are roughly equal to each other, and an odd number of louver groups are achieved by aligning roughly equal numbers of louvers evenly in series along said fins in a direction in which said adjacent heat exchangers are provided in parallel at said fins.

17. A parallel integrated heat exchanger according to claim 16, wherein a flat surface is formed between adjacent louver groups.

18. A parallel integrated heat exchanger according to claim 16, wherein a non-flat surface is formed by reducing the distance between adjacent louver groups.

19. A parallel integrated heat exchanger according to claim 16, wherein said louvers are inclined louvers inclining relative to the surfaces of said fins at which said louvers are formed.

20. A parallel integrated heat exchanger according to claim 16, wherein said louvers are parallel louvers lying parallel to the surfaces of said fins at which said louvers are formed.

21. A parallel integrated heat exchanger according to claim 16, further comprising a condenser and a radiator joined as one unit to form said parallel integrated heat exchanger.

22. A parallel integrated heat exchanger according to claim 21, wherein said condenser comprises a first pair of said tanks and said radiator comprises a second pair of said tanks.

23. A parallel integrated heat exchanger according to claim 22, wherein said condenser further comprises a plurality of said tubes communicating between said first pair of said tanks.

24. A parallel integrated heat exchanger according to claim 22, wherein said radiator further comprises a plurality of said tubes communicating between said second pair of said tanks and formed separately from said tubes of said condenser.

25. A parallel integrated heat exchanger according to claim 16, wherein a uniform formation mode is adopted to continuously form said heat transfer prevention louvers in an identical pattern with said performance-improving louvers.

26. A parallel integrated heat exchanger according to claim 16, wherein said odd number of louver groups are formed along a direction parallel to said fins so as to be shared by said heat exchangers.

27. A parallel integrated heat exchanger according to claim 17, wherein said louvers are parallel louvers lying parallel to the surfaces of said fins at which said louvers are formed.

28. A parallel integrated heat exchanger according to claim 18, wherein said louvers are parallel louvers lying parallel to the surfaces of said fins at which said louvers are formed.

* * * * *